US006059119A

United States Patent [19]

Davis

[11] Patent Number: 6,059,119

[45] Date of Patent: May 9, 2000

[54] ROCK SCREED BUCKET

[76] Inventor: Richard D. Davis, R.R. 1 Box 2417, Absarokee, Mont. 59001

[21] Appl. No.: 09/370,238

[22] Filed: Aug. 9, 1999

Related U.S. Application Data

[63] Continuation-in-part of application No. 08/838,338, Apr. 8, 1997, abandoned.

[51] Int. Cl.[7] ..... B07B 1/00

[52] U.S. Cl. ..... 209/233; 209/421; 209/419; 209/412; 209/405; 209/365.1; 172/816

[58] Field of Search ..... 209/421, 420, 209/419, 412, 405, 365.1; 172/816, 40

[56] References Cited

U.S. PATENT DOCUMENTS

| | | | |
|---|---|---|---|
| 751,197 | 2/1904 | Osgood | 209/419 |
| 1,108,270 | 8/1914 | Staples | 209/419 |
| 2,614,344 | 10/1952 | Rust | 172/816 |
| 2,825,985 | 3/1958 | Weeks | 172/816 |
| 4,698,150 | 10/1987 | Wigoda | 209/421 |
| 5,160,034 | 11/1992 | Potter | 209/405 X |
| 5,581,916 | 12/1996 | Hirose et al. | 209/421 X |

FOREIGN PATENT DOCUMENTS

| | | | |
|---|---|---|---|
| 2412663 | 8/1979 | France | 209/421 |
| 2612966 | 9/1988 | France | 209/421 |
| 1291555 | 10/1972 | United Kingdom | 209/421 |

*Primary Examiner*—Janice L. Krizek
*Assistant Examiner*—Steven B. McAllister

[57] ABSTRACT

The present new, improved rock screed bucket has a solid rectangular back plate together with a framework having a rectangular bottom and a pair of generally triangular shaped sides. The solid rectangular back plate acts as a backstop. The rectangular bottom supports a heavy duty grading screen. A mounting frame is mounted to the rear of the solid rectangular back plate through a plurality of shock absorbing spacers. The conventional arm structures and conventional hydraulic system of a conventional tractor or skid loader connect to the mounting frame. By rapidly moving the conventional arm structure and conventional hydraulic system any material in the rock screed bucket can be shaken and thus screened. In a second embodiment, a hydraulic shaker may be attached to the top of the rock screed bucket to shake the rock screed bucket. The hydraulic shaker is conventional and derives its power from the conventional hydraulic system of the tractor or skid loader.

5 Claims, 3 Drawing Sheets

ROCK SCREED BUCKET

This application is a continuation-in-part of application Ser. No. 08/838,338, filed Apr. 8, 1997, now abandoned. This application claims the benefits under 35 U.S.C. 119(e) of previously filed provisional application, Ser. No. 015,921 filed Apr. 22, 1996.

BACKGROUND OF THE INVENTION

1. Field of Invention

This invention relates to a new, improved rock screed bucket for use in separating and grading particularized material such as sand, gravel and rock and for connection to conventional arm structure and conventional hydraulic system of a mobile machine such as a tractor or front end loader.

2. Description of Prior Art

The prior art discloses the use of screens in combination with earth moving buckets and the use of screens to separate different substances.

U.S. Pat. No. 5,160,034 to Potter teaches a vibrating bucket screen attachment for cleaning beaches mounted on a mobile machine. Potter includes an outer excavating bucket with a sand scooping blade and runners on the outer bucket for supporting the outer bucket relative to the beach and an inner vibrating screen bucket which is resiliently mounted in the excavating bucket and includes a hydraulically operated vibrator. Potter teaches a floor screen portion of the inner bucket being mounted above the bottom sand-engaging portions of the outer bucket. Potter teaches an inner vibrating screen bucket set within a primary bucket by means of brackets and compression springs. The inner vibrating screen bucket further includes a vibrator mounted thereon. In operation, the vibrator vibrates only the inner vibrating screen bucket mounted within the primary bucket. In contrast to Potter, the applicant's invention herein provides for a less complex improved rock screed bucket.

U.S. Pat. No. 4,698,150 to Wigoda teaches a beach trash remover including a motorized vehicle having a conventional construction type shovel. Wigoda includes an opening covered by a screen in the center of the shovel, which screen is held on a frame which is coupled to the shovel through shock absorbers. Wigoda provides means for vibrating motion to the screened frame. Wigoda teaches the vibrating mechanism moving the screen frame within the shovel, dissimilar to the applicant's invention herein wherein the vibrator moves the improved rock screed bucket relative to the tractor or carrying vehicle.

U.S. Pat. No. 4,157,956 to Robinson teaches a screening bucket having a rear portion and a front portion supported for pivotal displacement toward and away from the rear portion. Robinson includes a pair of hydraulic slave cylinders connected to the front portion for establishing a closeable discharge opening and a deployable flexible screen for forming a perforated occlusion for the discharge opening comprising a web formed of a plurality of links defining a myriad of discharge openings through which contents of less than selected screen size is discharged from the bucket, and a power driven reel for alternately taking-up and paying-out the web as the front portion of the bucket is displaced relative to the rear portion thereof.

U.S. Pat. No. 3,072,257 to Hockenberry teaches a mechanism for digging, screening, washing, and loading gravel and the like for use with a bulldozer or the like. Hockenberry includes a material gathering member which is used as a jaw to close with the bulldozer blade in bucket manner to envelop the material to be screened. Hockenberry includes rotating the blade forward to position the material on the screen and then rocking the bucket on pivots to accomplish the screening.

It is therefore, the general purpose of the instant invention to provide an new, improved rock screed bucket which is simple, practical, and economic to manufacture, employ and maintain.

The new, improved rock screed bucket according to the present invention substantially departs from the conventional concepts, designs and complications of the prior art, and in doing so, provides an apparatus primarily developed for the purpose of providing an new, improved rock screed bucket which is simple, practical, and economic to manufacture, employ and maintain.

Therefore, it can be appreciated that there exists a continuing need for a new apparatus primarily developed for the purpose of providing an new, improved rock screed bucket which is simple, practical, and economic to manufacture, employ and maintain. In this regard, the present invention substantially fulfills this need.

As illustrated by the background art, efforts are continuously being made in an attempt to develop devices for separating and grading particularized material such as sand, gravel and rock. No prior effort, however, provides the benefits attendant with the present invention. Additionally, the prior patents and commercial techniques do not suggest the present simple inventive combination of component elements arranged and configured as disclosed and claimed herein.

The present invention achieves its intended purposes, objects, and advantages through a simple, new, useful and unobvious combination of component elements, with the use of a minimum number of functioning parts, at a reasonable cost to manufacture, maintain and replace, and by employing only readily available materials.

SUMMARY OF INVENTION

In view of the disadvantages inherent in the complexity in the prior art, the present invention provides a simple new, improved rock screed bucket that can be attached to a conventional tractor or skid loader in a manner similar to a bucket for a front-end loader. As such, the general purpose of the present invention, which will be described subsequently in greater detail, is to provide by simplicity an new, improved rock screed bucket which has all of the advantages of the prior art and none of the disadvantages.

The invention is defined by the appended claims with the specific embodiment shown in the attached drawings. For the purpose of summarizing the invention, the new, improved rock screed bucket has a solid rectangular back plate together with a framework having a rectangular bottom and a pair of generally triangular shaped sides. The solid rectangular back plate acts as a backstop. The rectangular bottom supports a heavy duty grading screen. A mounting frame is mounted to the rear of the solid rectangular back plate through a plurality of shock absorbing spacers. The conventional arm structures and conventional hydraulic system of a conventional tractor or skid loader connect to the mounting frame. The tractor or skid loader is used to raise or lower the new, improved rock screed bucket so as to control the height of the new, improved rock screed bucket above the ground and to rotate the new, improved rock screed bucket around a horizontal axis by activating the conventional hydraulic system. By rapidly moving the conventional arm structure and conventional hydraulic system any material in the new, improved rock screed bucket can be shaken and thus screened.

In a second embodiment, a hydraulic shaker is attached to the top of the new, improved rock screed bucket to shake the new, improved rock screed bucket on the mounting frame after it is lifted above the ground. The hydraulic shaker is conventional and derives its power from the conventional hydraulic system of the tractor or skid loader.

When material is loaded into the new, improved rock screed bucket and the new, improved rock screed bucket lifted off the ground and shaken, the smaller or predetermined sized material is separated and passes through the mesh of the screen onto the ground while the larger material is retained within the new, improved rock screed bucket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new, improved rock screed bucket for use in separating and grading particularized material such as sand, gravel and rock.

It is another object of the present invention to provide a new, improved rock screed bucket which is simple and of a reasonable cost to manufacture, maintain and replace.

It is a further object of the present invention to provide a new, improved rock screed bucket which is of a durable and reliable construction.

An even further object of the present invention is to provide a new, improved rock screed bucket which is susceptible of a low cost of manufacture with regard to both materials and labor, and which accordingly is then susceptible of low prices of sale to the consuming public, thereby making such new, improved rock screed bucket economically available to the buying public.

Still yet another object of the present invention is to provide a new, improved rock screed bucket which provides in the apparatus and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive means in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
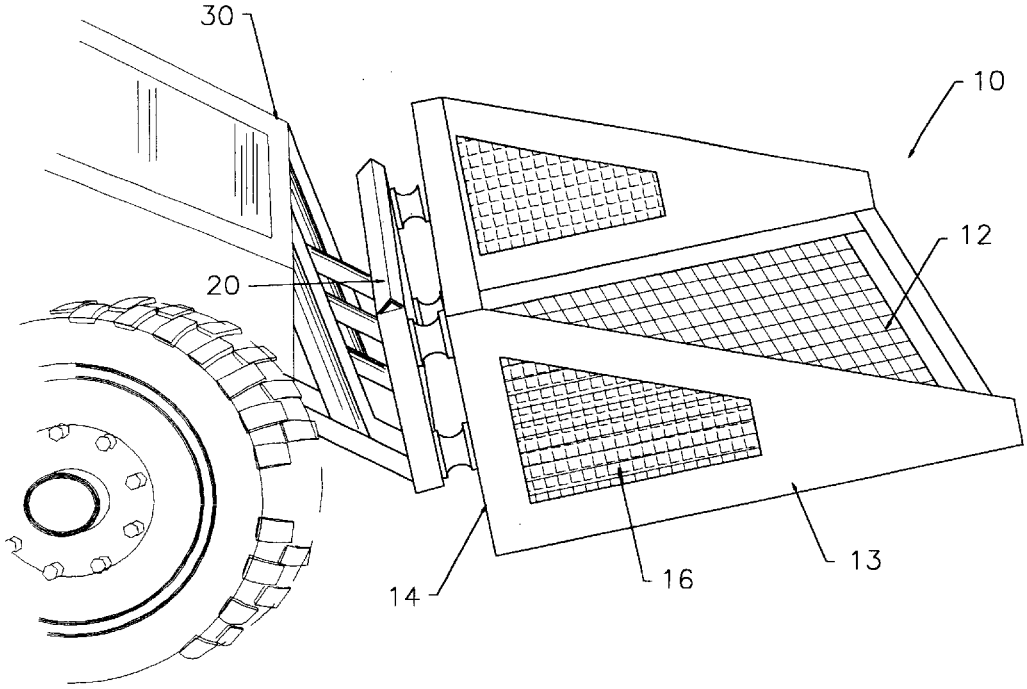
FIG. 1 is a perspective view of the new, improved rock screed bucket mounted on a mobile machine such as a tractor and showing screen generally triangular shaped side frames.
Figure 2:
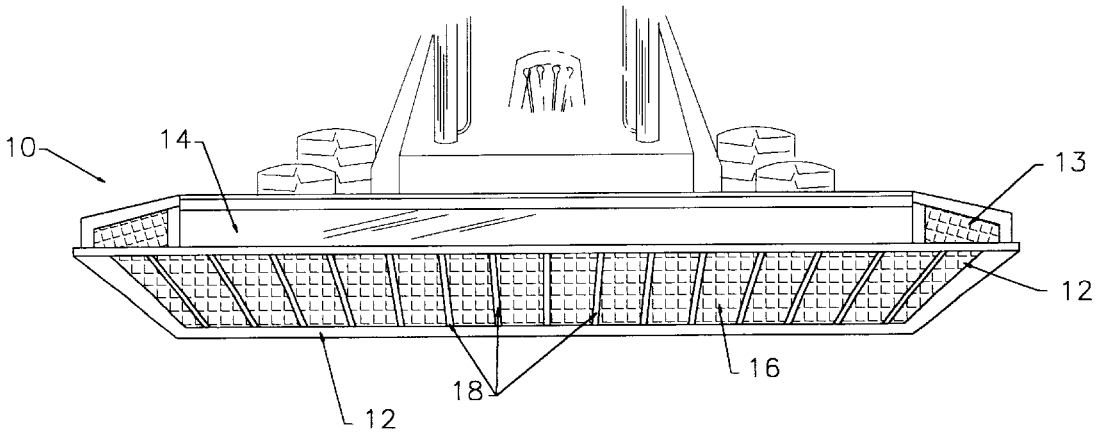
FIG. 2 is a front view of the new, improved rock screed bucket.

With reference now to the drawings, a new, improved rock screed bucket embodying the principles and concepts of the present invention will be described. A preferred embodiment of the new, improved rock screed bucket 10 is shown in FIG. 1. The new, improved rock screed bucket 10 has a solid rectangular back plate 14 together with framework having a rectangular bottom 12 and a pair of generally triangular shaped side frames 13. The pair of generally triangular shaped side frames 13 and rectangular bottom 12 are joined along their corresponding edges with angle iron. In one embodiment, a screen 16 is attached to the rectangular bottom 12 and to the generally triangular shaped side frames 13 to grade any material that is placed in the new, improved rock screed bucket 10. In another embodiment, the screen 16 is attached to the rectangular bottom 13 and the generally triangular shaped side frames 13 are solid. Only material smaller than the screen mesh can pass through the screen 16.

Figure 3:
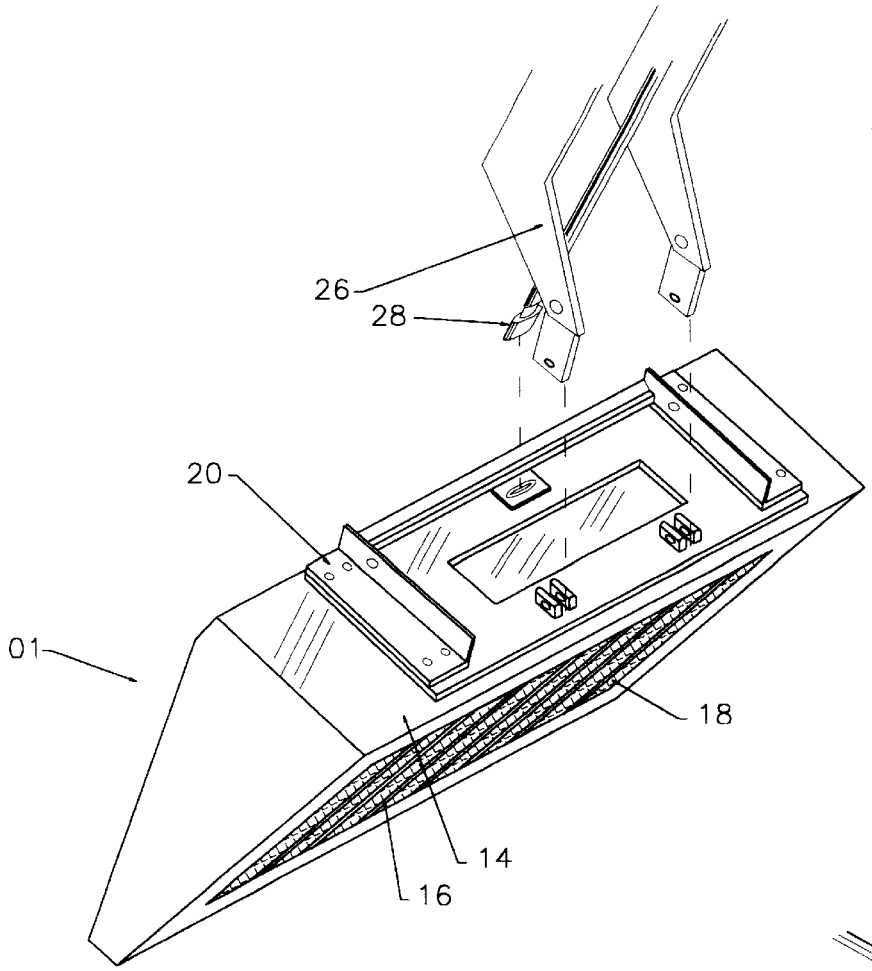
FIG. 3 is a rear perspective view of the new, improved rock screed bucket showing the mounting frame to a mobile machine such as a tractor and the solid generally triangular shaped side frames.

As best seen in FIG. 3, a plurality of rods 18, connecting to the rectangular bottom 12 and extending from the front to back underneath screen 16, support heavy loads without the loads causing serious deformation to the screen 16.

Figure 4:
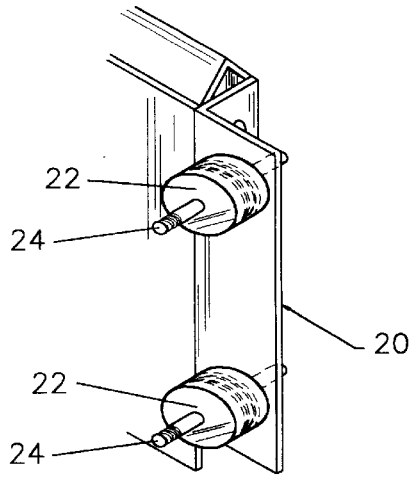
FIG. 4 is a partial view of the mounting frame spaced apart from the new, improved rock screed bucket.

As best seen in FIGS. 3 and 4, new, improved rock screed bucket 10 has a mounting frame 20 spaced apart from the rear of solid rectangular back plate 14 by a plurality of shock absorbers 22. A plurality of mounting bolts 24, passing through said mounting frame 20, said plurality of shock absorbers 22, and said solid rectangular back plate 14 hold mounting frame 20 firmly with, but spaced apart from, said solid rectangular back plate 14.

Mounting frame 20 also has a plurality of holes appropriately drilled to connect conventional arm structure 26 and conventional hydraulic system 28 of a conventional tractor 30 by rotatably bolting the conventional arm structure 26 and conventional hydraulic system 28 to the mounting frame 20.

Figure 5:
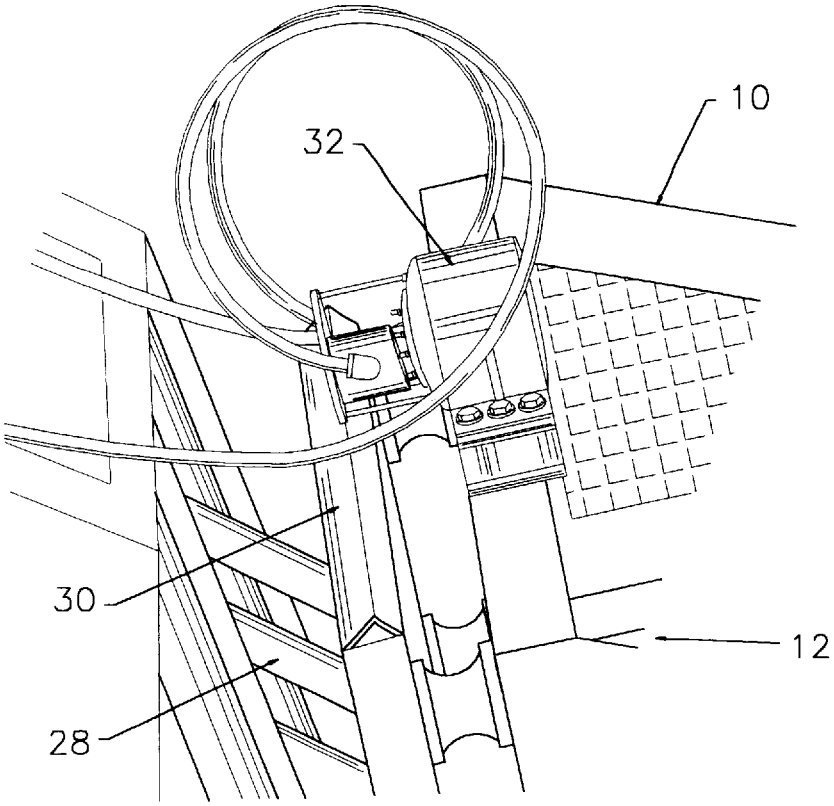
FIG. 5 is a side view of a hydraulic shaker mounted to the new, improved rock screed bucket.
Figure 6:
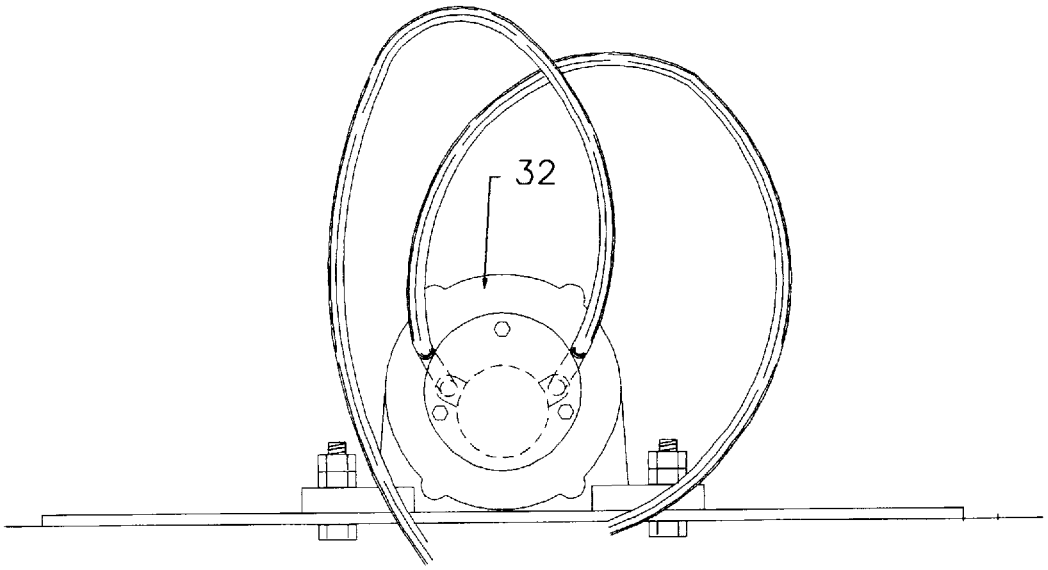
FIG. 6 is a rear view of the hydraulic shaker shown in FIG. 5.

FIGS. 5 and 6 illustrate a second embodiment of the present invention. A hydraulic shaker 32, such as a Minnich Maginnis, Model No. D7-18-8-HC, is mounted to the new, improved rock screed bucket 10 to vibrate the new, improved rock screed bucket 10 on the mounting frame 20. The vibration helps to sift material, smaller than the mesh of screen 16, through the screen 16. Material larger than the mesh of screen 16 remains in the new, improved rock screed bucket 10.

In operation, new, improved rock screed bucket 10 is mounted to a conventional tractor or skid loader by connecting conventional arm structure 26 and conventional hydraulic system 28 of a conventional tractor or skid loader to mounting frame 20. Material is shoveled or scooped into new, improved rock screed bucket 10 and new, improved rock screed bucket 10 lifted off the ground by using conventional arm structures 26 and rotated vertically by conventional hydraulic system 28. New, improved rock screed bucket 10 can then be jostled by conventional arm structure 26 and conventional hydraulic system 28 in the preferred embodiment, or shaken by hydraulic shaker 32 in the second embodiment. Shaking the new, improved rock screed bucket 10 permits material smaller than the mesh of screen 16 to pass through the screen 16 and onto the ground below the screen 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

While particular embodiments of the invention have been shown and described, it will be understood that the invention is not limited thereto, since modifications may be made that will become apparent to those skilled in the art.

What is claimed is:

1. A rock screed bucket for use in separating and grading particularized material and for connection to conventional arm structure and conventional hydraulic system of a mobile machine such as a tractor or front end loader, said rock screed bucket comprising:

a solid rectangular back plate extending substantially the width of the screed bucket;

a framework, said framework having a rectangular bottom at a substantially right angle to the solid rectangular back plate and a pair of triangular side frames and being joined to said solid rectangular back plate;

said pair of triangular side frames and rectangular bottom being joined;

a screen, said screen being attached to said rectangular bottom and said pair of triangular side frames respectively;

a plurality of rods, said rods connecting to said framework and extending underneath said screen;

a mounting frame, said mounting frame being spaced apart from and attaching to said solid rectangular back plate;

a plurality of shock absorbing spacers, said plurality of shock absorbing spacers attaching said mounting frame to said solid rectangular back plate;

a plurality of mounting bolts, said plurality of mounting bolts passing through said mounting frame, said plurality of shock absorbing spacers, and said solid rectangular back plate, and holding said mounting frame firmly with, but spaced apart from, said solid rectangular back plate; and, a plurality of holes, said plurality of holes being drilled in said mounting frame to connect conventional arm structure and conventional hydraulic system of a mobile machine such as a tractor or front end loader.

2. The rock screed bucket of claim 1 further comprising said pair of triangular side frames and rectangular bottom being joined with angle iron.

3. The rock screed bucket of claim 1 further comprising a hydraulic shaker being mounted to said rock screed bucket.

4. The rock screed bucket of claim 3 further comprising said pair of triangular side frames being solid.

5. The rock screed bucket of claim 1 further comprising said pair of triangular side frames being solid.

* * * * *